US007107729B2

(12) United States Patent
Baratuci et al.

(10) Patent No.: US 7,107,729 B2
(45) Date of Patent: Sep. 19, 2006

(54) RIBBED TUBE CONTINUOUS FLEXIBLE SPACER ASSEMBLY

(75) Inventors: James Lynn Baratuci, Stow, OH (US); Patrick Anthony Drda, Lyndhurst, OH (US); Steven Michael Milano, Aurora, OH (US); Theo J Van de Pol, Ew Heerde (NL)

(73) Assignee: AFG Industries, Inc., Kingsport, TN (US)

( * ) Notice: Subject to any disclaimer, the term of this patent is extended or adjusted under 35 U.S.C. 154(b) by 0 days.

(21) Appl. No.: 10/004,365

(22) Filed: Nov. 1, 2001
(Under 37 CFR 1.47)

(65) Prior Publication Data

US 2003/0150177 A1 Aug. 14, 2003

Related U.S. Application Data

(60) Provisional application No. 60/246,885, filed on Nov. 8, 2000.

(51) Int. Cl.
*E06B 3/66* (2006.01)

(52) U.S. Cl. ..... 52/204.593; 52/204.6; 52/204.599; 52/786.11; 52/786.1

(58) Field of Classification Search ..... 52/204.6, 52/204.57, 204.58, 204.599, 786.1, 786.13, 52/786.11, 204.593, 656.9; 138/121, 99
See application file for complete search history.

(56) References Cited

U.S. PATENT DOCUMENTS

| | | | | | |
|---|---|---|---|---|---|
| 2,828,235 | A | | 3/1958 | Holland et al. | |
| 3,891,007 | A | * | 6/1975 | Kleykamp | 138/121 |
| 4,431,691 | A | * | 2/1984 | Greenlee | 428/34 |
| 4,487,707 | A | * | 12/1984 | Holzknecht | 252/68 |
| 4,576,841 | A | | 3/1986 | Lingemann | |
| 4,791,773 | A | | 12/1988 | Taylor | |
| 4,831,799 | A | * | 5/1989 | Glover et al. | 52/172 |
| 5,013,377 | A | | 5/1991 | Lafond | |
| 5,209,034 | A | | 5/1993 | Box et al. | |
| 5,270,091 | A | * | 12/1993 | Krysiak et al. | 428/68 |
| 5,349,988 | A | * | 9/1994 | Walsh et al. | 138/109 |
| 5,436,040 | A | | 7/1995 | Lafond | |
| 5,441,779 | A | | 8/1995 | Lafond | |
| 5,443,871 | A | | 8/1995 | Lafond | |
| 5,447,761 | A | | 9/1995 | Lafond | |
| 5,458,943 | A | * | 10/1995 | Taylor | 428/34 |
| 5,472,558 | A | | 12/1995 | Lafond | |
| 5,485,710 | A | | 1/1996 | Lafond | |
| 5,491,953 | A | | 2/1996 | Lafond | |
| 5,498,451 | A | | 3/1996 | Lafond | |
| RE35,291 | E | | 7/1996 | Lafond | |

(Continued)

FOREIGN PATENT DOCUMENTS

| | | |
|---|---|---|
| DE | 3529434 A1 | 2/1986 |

(Continued)

OTHER PUBLICATIONS

International Preliminary Examination Report, PCT/US01/18282, Jun. 6, 2001.

(Continued)

*Primary Examiner*—Basil Katcheves
(74) *Attorney, Agent, or Firm*—Rothwell, Figg, Ernst & Manbeck

(57) ABSTRACT

A spacer assembly is disclosed having a spacer with a cross-section varying in a repeating manner along a longitudinal axis and an adhesive sealant at least partially encapsulating the spacer. Also, a moisture vapor barrier may be provided as well as a desiccated topcoat.

16 Claims, 3 Drawing Sheets

U.S. PATENT DOCUMENTS 5,616,415 A 4/1997 Lafond
5,635,019 A 6/1997 Lafond
5,650,029 A 7/1997 Lafond
5,656,358 A 8/1997 Lafond
5,658,645 A 8/1997 Lafond
5,691,045 A 11/1997 Lafond
5,713,177 A * 2/1998 Peterson ..... 52/741.1
5,759,665 A 6/1998 Lafond
5,762,738 A 6/1998 Lafond
5,773,135 A 6/1998 Lafond
5,799,703 A * 9/1998 Kanao et al. ..... 138/121
5,806,272 A 9/1998 Lafond
5,813,191 A 9/1998 Gallagher
5,829,483 A * 11/1998 Tukahara et al. ..... 138/109
5,851,609 A 12/1998 Baratuci et al.
5,876,554 A 3/1999 Lafond
5,888,341 A 3/1999 Lafond
5,975,181 A 11/1999 Lafond
6,001,453 A 12/1999 Lafond
6,035,602 A 3/2000 Lafond
D422,884 S 4/2000 Lafond
6,148,890 A 11/2000 Lafond
6,192,652 B1 2/2001 Goer et al.
6,238,755 B1 * 5/2001 Harvey et al. ..... 428/34
6,250,358 B1 6/2001 Lafond
6,329,030 B1 12/2001 Lafond
6,332,948 B1 12/2001 Lafond
6,378,586 B1 4/2002 Lafond
6,394,164 B1 5/2002 Lafond
6,434,910 B1 8/2002 Deane
6,528,131 B1 3/2003 Lafond
6,581,341 B1 * 6/2003 Baratuci et al. ..... 52/204.5

FOREIGN PATENT DOCUMENTS

EP 0 500 483 A1 2/1992
EP WO 97/26434 7/1997
WO WO 97/06332 2/1997

OTHER PUBLICATIONS

Written Opinion, PCT/US01/18282, Nov. 12, 2002.

* cited by examiner

RIBBED TUBE CONTINUOUS FLEXIBLE SPACER ASSEMBLY

This application claims the benefit of Provisional Application No. 60/246,865, filed Nov. 8, 2000.

FIELD OF INVENTION

This invention relates to a composite spacer and sealant which can be used particularly in the fabrication of thermally insulating laminates such as windows.

BACKGROUND OF INVENTION

In general, the procedure for assembling an insulated window structure involves placing one sheet of a glazed structure over another in a fixed,spaced relationship, and then injecting a sealant composition into the space between the two glazed structures, at and along the periphery of the two structures, thereby forming a sandwich-type structure having a sealed air pocket between the structures. In practice, glazed structures are typically glass but can also be plastic. To keep the glazed structures properly spaced apart, a spacer bar is often inserted between the two structures to maintain proper spacing while the sealant composition is injected into place. Also, the spacer bar and sealant can be prefabricated into a solitary unit and after fabrication placed into the space between the glazed structures to form the window structure.

Moisture and organic materials are often trapped inside the sealed air space as a result of the window assembly fabrication process. To minimize the effects of moisture and organic materials trapped in the sealed air pocket, desiccants can be used as a medium to absorb these artifacts. Typically, however, at least some moisture will enter or remain in the sealed air pocket during the time the window assembly is in field service. This use of desiccants prevents moisture from condensing on and fogging interior surface of the glass sheets when the window assembly is in service. Desiccants can be incorporated into the spacer, into the sealant or into the entire unit when the sealant/spacer assembly is a solitary component. Additional desiccants above the amount required to absorb the initial moisture content are included in the spacer/sealant assembly in order to absorb additional moisture entering the window assembly over its service life.

Thermal conductivity in the edge of a window units is typically higher than in the center because thermal energy will less readily pass from glazed structure to glazed structure through the air contained in the sealed air pocket than through the materials comprising the sealant/spacer assemblies known in the art.

Various prior art practices for manufacturing window assemblies are cumbersome, labor intensive or require expensive equipment. An answer to the previously discussed limitations is provided by U.S. Pat. No. 4,431,691, to Greenlee, in which a sealant and spacer strip having a folded or contoured spacer means to maintain the relative distance under compression of glass sheets, wherein the strip comprises a folded or contoured spacer means embedded or enveloped in a deformable sealant. This spacer strip has the advantage of being flexible along its longitudinal axis to enable it to be coiled for storage. The Greenlee assembly is thus a solitary component in which the sealant contains the desiccant.

Greenlee's assembly, while addressing previous limitations does not provide a flat sightline once the glass unit is constructed due to undulations in the spacer after the glazed structure are compressed into place. The sightline in a window is the portion of the spacer/sealant assembly that is viewed through the glass sheets, but is not in contact with these sheets. This flat sightline is desirable to improve aesthetic qualities of installed windows. Also, the Greenlee teaching uses high amounts of sealant material required to envelope the spacer and the folded assembly can be stretched during application as well as along its longitudinal axis. This stretching can also lead to problems in maintaining a flat sightline.

SUMMARY OF THE INVENTION

There remains a need for an improved continuous spacer assembly that eliminates longitudinal stretching while making it easier to produce a window assembly having a smooth sightline. Moreover, it would be desirable if such a continuous spacer assembly could be fabricated to yield a more cost-effective product while providing the structural stability and benefits of the Greenlee construction. Also, it would be desirable if such assembly allowed for a sharper radius when bending the spacer assembly at the corners.

Thus, the continuous spacer assembly of the present invention presents advantages by eliminating the amount of necessary sealant material while maintaining the performance of the sealant and spacer strip; eliminating expensive and intricate spacer bar constructions; eliminating the tendency of the material to stretch along its longitudinal axis; reducing thermal conductivity of the insulated window structure by reducing the thermal conductivity of the spacer assembly and providing the necessary ability to form sharper corners.

It is a further object of the present invention that it be coilable for ease of storage, dispensing and applying to laminate structures such as insulated glass units.

In accordance with one aspect of the present invention, there is provided a flexible, crush-resistant sealant and spacer strip or composite tape structure comprising a longitudinally extending spacer, including a ribbed or corrugated tube of a flexible material. The tube is in at least partial contact with an adhesive, desiccated sealant. In one embodiment, a moisture vapor barrier is included in the adhesive layer. In yet another embodiment, a desiccant containing topcoat is provided.

DETAILED DESCRIPTION

Figure 1:
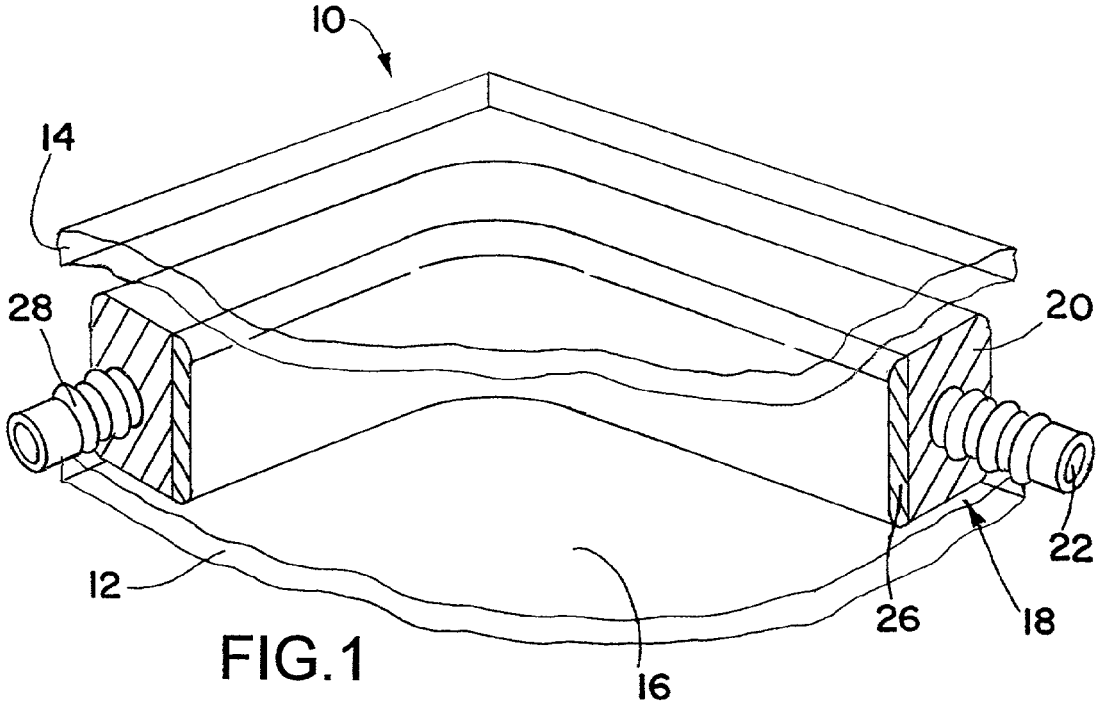
FIG. 1 is a fragmentary perspective view with parts in section showing an embodiment of a window made in accordance with the present invention.

Referring now to the drawings, it will be seen that FIG. 1 illustrates a composite structure, such as, but not limited to a window assembly, 10 comprising first substrate member 12 and second substrate member 14 having facing, generally parallel surfaces. First and second substrate members 12, 14 are generally glazed structures such as glass panes. The substrate members are 12, 14 joined together to form an enclosed space 16 which is hermetically sealed by a composite tape structure, i.e., spacer/sealant assembly 18, which includes sealant 20 which at least partially envelopes a spacer 22. Glazed structures 12, 14, as illustrated, are formed of glass. It should be appreciated that the invention has applicability in the environment of an unrestricted variety of construction or structural materials, including, for example, cement, concrete, brick, stone, metals, plastics, and wood.

Figure 3:
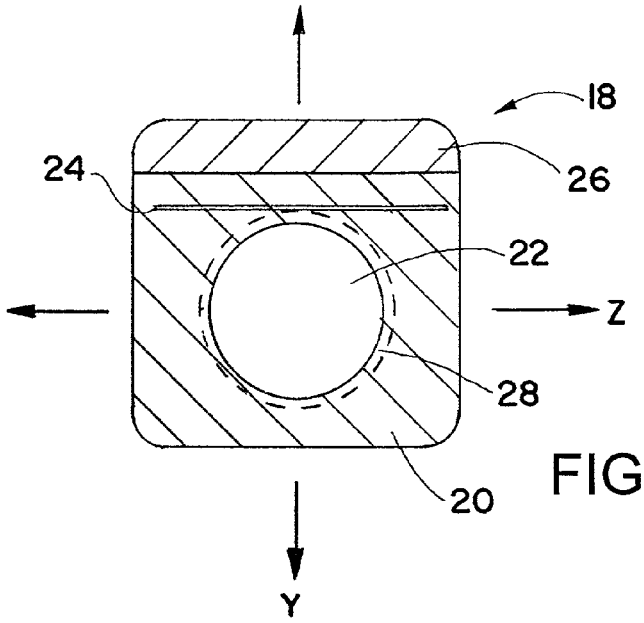
FIG. 3 is a cross-section of the spacer assembly of the embodiment of FIG. 1.
Figure 4:
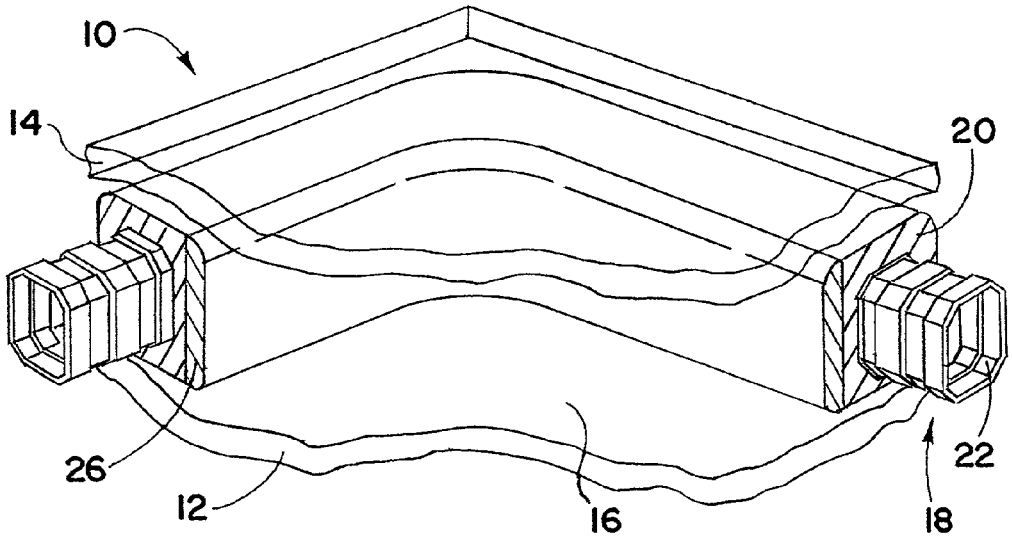
FIG. 4 is a fragmentary perspective view with parts in section showing another embodiment of a window made in accordance with the present invention.
Figure 6:
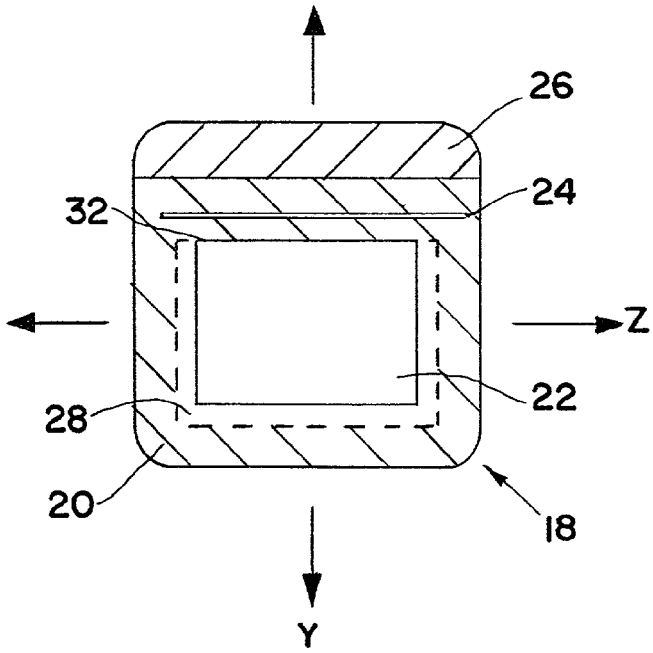
FIG. 6 is a cross-section of the spacer assembly of the embodiment of FIG. 4.

As illustrated in FIGS. 1 and 4, for purposes of this patent, "interior" means facing into the sealed air space 16 of the window assembly 10 while "exterior" means facing out of the sealed air space 16 of the window assembly 10. Also, FIGS. 3 and 6 illustrates the orientation of the respective x, y, and z axes.

In one embodiment of the present invention as illustrated in FIGS. 1, it can be seen that the invention comprises a spacer tube 22 and an adhesive sealant 20. In another embodiment, a moisture vapor barrier 24 is provided within the adhesive sealant 20. In a preferred embodiment, the tube 22 is at least partially encapsulated by adhesive sealant 20 with the moisture vapor barrier 24 carried within the adhesive sealant 20. The adhesive sealant 20 may also contain a desiccant. The present invention may also include a topcoat 26 adhered to an interior facing surface of the adhesive sealant 20. The topcoat 26 substantially runs along the sightline and is often used to improve the aesthetics of the window assembly 10 while also containing a desiccant. The topcoat 26 may contain the desiccant or alternatively, both the adhesive sealant 20 and the topcoat 26 may contain desiccant.

The spacer 22 is a elongated structure which can be bent to form a corner and has a cross-section that varies in a repeating manner along the elongated structure's longitudinal axis. In a preferred embodiment, the spacer 22 is a tube. As seen in FIGS. 1, 2, 4, 5 and 6 the spacer tube 22 is preferably corrugated or ribbed i.e. having alternating furrows and ridges on at least its outside surface. For purposes of this application, "ribbed" or "corrugated" may be used interchangeably. Also, one of skill in the art will readily understand that an inside surface of the ribbed tube may be either smooth, ribbed or an alternating mixture of both.

The ribs 28 of the tube 22 aid in forming corners by allowing greater flexibility when applying a bending force to the tube 22 while eliminating kinking of the tube. Thus, the outer dimension of the cross-sectional area and the inner dimension of the cross-sectional area of the tube 22 remain substantially the same when forming a corner. Also, the ribs 28 of the corrugated tube 22 can help to maintain the corner formation once the tube 22 is bent into that position. It is contemplated, however, that one of skill in the art would readily appreciate that other types of tubing can be used with the present invention.

Figure 2:
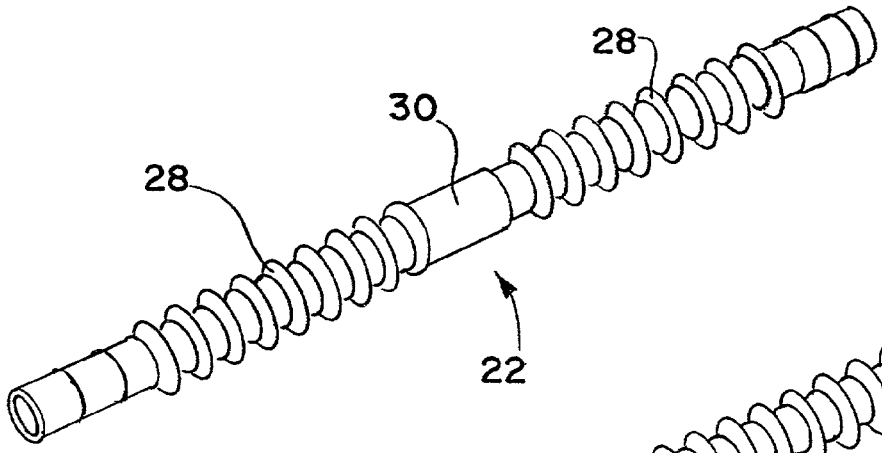
FIG. 2 is a plan view of a ribbed or corrugated tube in accordance with an embodiment of the present invention.
Figure 2A:
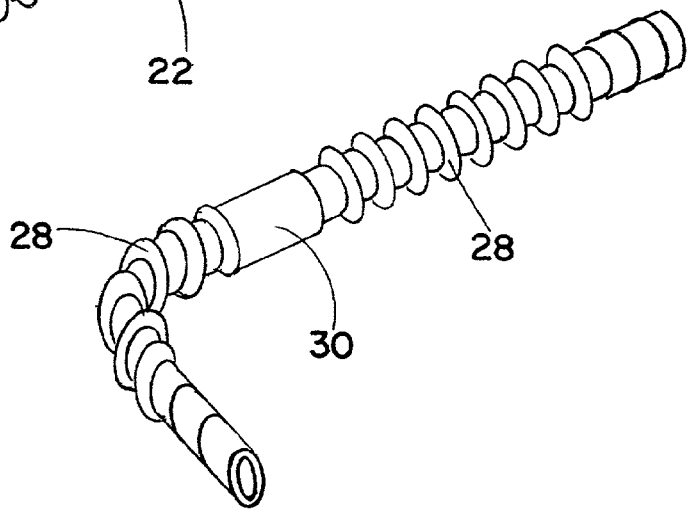
FIG. 2A is a plan view of a ribbed or corrugated tube bent into a corner-type configuration in accordance with an embodiment of the present invention.

In one embodiment, it is the spacer's 22 cross-sectional area that varies in a repeating manner along a longitudinal axis. An annular configuration is exemplary of a spacer 22 having such a cross-sectional area. An annular configuration will also typically have individual, at least partly circumferential ribs 28. FIGS. 2 and 2A illustrate an embodiment of the present having differing rib sizes and unribbed portions 30 of the tube. One of skill in the art will readily appreciate that different rib configurations may be utilized to fabricate a tube that is more easily bent into corners. Furthermore, different configured ribs may be used as locking ribs.

In another embodiment, it is the orientation of the cross-section that varies in a repeating manner along a longitudinal axis. A helical configuration is exemplary of a spacer 22 having such a cross-section. A helical configuration will typically have a single rib rotating about the spacer for substantially its entire length. One of skill in the art will readily appreciate that other configurations of ribs 28 may still constitute a helical configuration.

Figure 5:
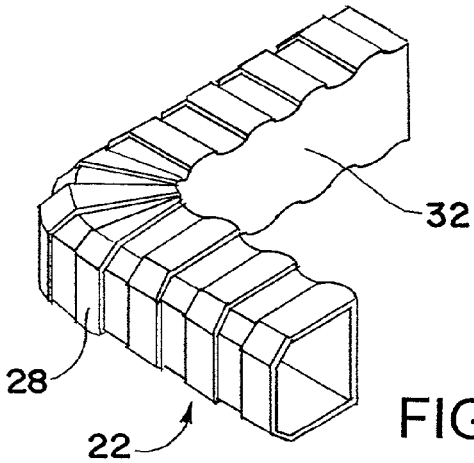
FIG. 5 is a plan view of a ribbed or corrugated tube in accordance with an the embodiment of FIG. 4.

FIGS. 4–6 illustrate embodiments of the present invention having a spacer 22 with a generally rectangular cross-sectional configuration. One of skill in the art will appreciate, however, that virtually any polygonal configuration, regular or irregular, can be used as well as any combination of arcs and straight lines resulting in a closed figure. As illustrated in FIG. 4, while the cross-sectional configuration is generally rectangular, it can be seen that in this embodiment, the corners are slightly angled giving this embodiment an eight-sided cross section that is generally rectangular.

The ribbed tube 22 can have any closed cross-sectional configuration including, but not limited to, circular, round, oval, elliptical, rectangular or polygonal. In FIG. 3, an embodiment is illustrated having a generally circular cross-section. Also, the embodiment of FIG. 3, as best seen in FIGS. 2 and 2A, has individual ribs 28 extending about the entire cross-section. In this embodiment, the ribs 28 are preferably annular.

Figure 5A:
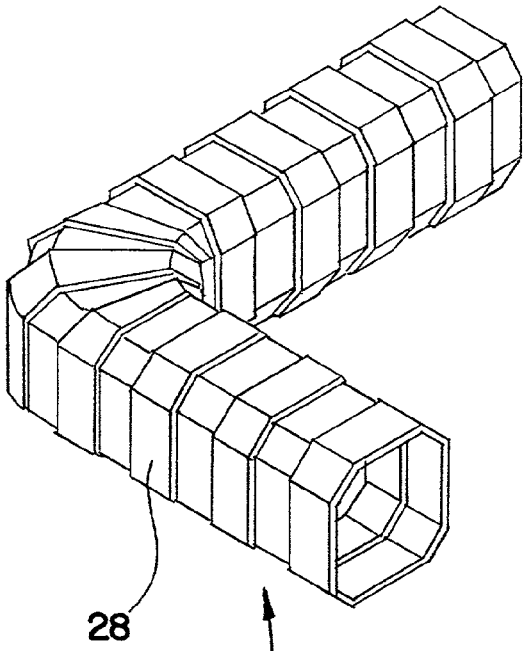
FIG. 5A is a plan view of a ribbed or corrugated tube in accordance with an the embodiment of FIG. 4

In yet another embodiment of the present invention, the ribs 28 of corrugated tube 22 only extend partially around the tube 22. As illustrated in FIG. 5A, the ribs 28 generally extend only around three sides of a generally rectangular configured corrugated tube 22. In FIG. 5A, the surface lacking ribs, the sightline surface 32, is preferably the surface which faces the interior of the window assembly. Furthermore, adhesive sealant and/or topcoat may be eliminated from this surface. This allows the smooth surface of the rectangular corrugated tube 22 to provide the desirable smooth sightline. When the adhesive sealant 20 and topcoat 26 are eliminated, it is preferable to have the desiccant contained in the material forming the tube 22.

The ribbed tube 22 may be constructed from any suitable material including plastics, elastomers, metals, paperstocks or laminates of any combination of these materials. The ribbed tube 22 may be formed from any variety of well known methods including continuous molding or blow molding. The ribbed tube 22 may also include reinforcing wires.

Due to the ribbed construction, the tube 22 is "crush-resistant," i.e., capable of resisting forces tending to reduce the spacing between the glazed structures during use.

The moisture vapor barrier 24 may be fabricated from aluminum foil, plastic, plastic laminates, paper/foil, metallicized plastic or any other suitable combination of the above with a plastic/aluminum laminate being preferred. In other applications, the moisture vapor barrier 24 may be chosen for different barrier properties relative to the type of application desired. For instance, the moisture vapor barrier 24 may be chosen to maintain the present concentration of a gas contained within the sealed air space of the composite structure.

The moisture vapor barrier 24 can be joined to the ribbed tube 22 and also can contact the adhesive sealant 20 and/or topcoat 26, can be embedded within the adhesive sealant 20 and not in contact with the ribbed tube 22, or it can be adhered to the interior-facing surface of the sealant 20 with the topcoat 26 joined to the interior surface of the moisture vapor barrier 24. The moisture vapor barrier 24 may be joined to the corrugated tube 22 by any suitable means such as by welding, thermally fusing, or adhesives.

The sealant 20 can subsequently be applied to the ribbed tube 22, whether or not a moisture vapor barrier 24 is provided, such as by dipping, painting, injecting or extruding the sealant to the sealant engaging surfaces of the ribbed tube. Desiccant is preferably carried in the sealant and the sealant/desiccant is applied to the sealant engaging surfaces and the interior surface of the spacer 22 in a single step.

The sealant 20 seals the gap between the tube 22 and the glazed structures 12, 14. The bond formed between the spacer/sealant assembly and a glazed structure is referred to as a bondline. Thus, at least two sealant engaging surfaces of the ribbed tube 22 include longitudinally extending ribbons of sealant which contact a glazed structure resulting in a bondline.

Suitable dimensions for the spacer/sealant assembly 18 will depend upon the window construction with the length generally corresponding to the window perimeter length. The width, i.e. the z-direction, generally corresponds to the space between the members plus the adhesive sealant 20. The ribbed tube 22, however, will often be slightly smaller than the desired spacing between the glazed structures 12, 14. When sealant 20 is added to the ribbed tube 22 a slightly greater width than the desired spacing is fabricated. The desired spacing is obtained during manufacture when the glazed structures 12, 14 are pressed together to achieve the final desired spacing. It should be understood, however, that the present invention can be manufactured in continuous lengths for any desired length resulting in flexibility for any application.

The term "deformable" as used herein, is intended to characterize a sealant 20, whether thermoplastic, thermosetting, or thermoplastic-thermosetting, which when used in the fabrication of composite structures, such as window assemblies 10, contemplated by this invention, is at least initially incapable of resisting deforming forces exerted upon it. Thus, the term deformable is intended to characterize a material which resists deformation or flow under low forces placed on a window assembly 10 throughout its liftetime, but is readily deformable under higher forces encountered during manufacture of a window assembly 10.

A wide variety of materials may be used as the base for the adhesive sealant 20, including polysulfide polymers, urethane polymers, acrylic polymers, silicones and the styrene-butadine polymers. Included among the latter are a class of thermoplastic resins which, when below their flow temperature, exhibit elastic properties of vulcanized polymers. Such resins are sold by Shell Chemical Co. under the trademark "Kraton". A preferred class of sealants 20 is butyl rubbers. The adhesive sealant 20, however, is preferably a pressure sensitive adhesive. If a topcoat 26 is applied, the topcoat 26 is preferably a desiccant loaded, deformable material.

As stated earlier, insulated window assemblies 10 often require a desiccant to minimize the effects of moisture and organic materials trapped in the air space between the two glazed structures 12, 14 of the window assembly 10. Conveniently, in the present invention, the desiccant can be incorporated within the deformable adhesive sealant 20 and this can be applied to the interior of the sealant 20 or, alternatively, a separate desiccant containing material can be used and co-extruded or otherwise applied to the sightline surface 32 of the spacer. A particularly suitable class of materials for this purpose is synthetically produced crystalline zeolite sold by UOP Corporation under the name "Molecular Sieves." Another desiccant which may be used is silica gel. Combinations of different desiccants are also contemplated.

The preferred method of manufacturing the spacer/sealant assembly 18 in accordance with the present invention is by co-extrusion. This can be accomplished with commercially available co-extruding equipment which, in some instances, may require minor modification. In general, the ribbed tube 22 is fed through the center of an extrusion die and the deformable sealant is extruded about the tube 22. The sealant and spacer assembly is then fed through a sizing die to obtain a sealant and spacer strip having the desired outside dimensions and the proper thickness of sealant extending beyond the spacer 22. Also, the sealant and spacer assembly 18 of the present invention will be coilable for ease of storage and quick dispensability during application. A releasable liner or paper can be applied to the interior or exterior of the spacer/sealant assembly 20 longitudinally along the sightline for ease of coiling. As the sealant/spacer assembly 20 is applied to form a window assembly 10, the releasable liner is removed and discarded.

In one embodiment, the ribbed tube 22 is fabricated and then enveloped, either completely or partially, with adhesive sealant 20. The topcoat 26 can also be applied simultaneously with the adhesive sealant 20 or afterwards, if so desired.

While in accordance with the patent statutes the best mode and preferred embodiment has been set forth, the scope of the invention is not limited thereto, but rather by the scope of the attached claims.

What is claimed is:

1. A window assembly comprising:

a flexible, hollow spacer having a cross-section varying in a repeating manner about a longitudinal axis;

an adhesive sealant at least partially encapsulating said spacer and having a first glazed structure engaging surface and a second glazed structure engaging surface opposite said first glazed structure engaging surface;

a first glazed structure engaged with said first glazed structure engaging surface of said adhesive sealant; and a second glazed structure engaged with said second glazed structure engaging surface of said adhesive sealant.

2. The window assembly of claim 1 wherein said spacer has a cross-sectional area varying in a repeating manner along said longitudinal axis.

3. The window assembly of claim 2 wherein said spacer having a cross-sectional area varying in a repeating manner along a longitudinal axis is a tube.

4. The window assembly according to claim 3 further comprises a moisture vapor barrier having at least one adhesive sealant engaging surface joined to said adhesive sealant.

5. The window assembly according to claim 4 wherein said cross-sectional area of said tube is generally rectangular.

6. The window assembly according to claim 4 wherein said adhesive sealant further comprises a desiccant.

7. The window assembly according to claim 6 further comprising: a desiccant containing topcoat joined to a topcoat engaging surface of said adhesive sealant.

8. The window assembly according to claim 4 wherein said desiccant containing topcoat is also joined to a topcoat engaging surface of said moisture vapor barrier.

9. The window assembly of claim 1 wherein said spacer has a cross-section varying in orientation along said longitudinal axis.

10. The window assembly according to claim 1 wherein said spacer is coilable.

11. A window assembly comprising:

a ribbed tube;

an adhesive sealant at least partially encapsulating said tube and having a first glazed structure engaging surface and a second glazed structure engaging surface opposite said first window engaging surface;

a moisture vapor barrier having an adhesive sealant engaging surface joined to said adhesive sealant;

a desiccant containing topcoat joined to said adhesive sealant;

a first glazed structure engaged with said first glazed structure engaging surface of said adhesive sealant; and a second glazed structure engaged with said second glazed structure engaging surface of said adhesive sealant.

12. The window assembly according to claim 11 wherein said ribbed tube has a generally rectangular cross-sectional area.

13. The window assembly according to claim 12 wherein said ribbed tube is ribbed at least along a first glazed structure engaging surface, a second glazed structure engaging surface opposing said first glazed structure engaging surface and an exterior surface disposed between said first and second bonding surfaces.

14. The window assembly according to claim 13 wherein said ribbed tube further comprises an interior surface substantially free of any ribs.

15. The window assembly according to claim 14 wherein said adhesive sealant is adhered to said first glazed structure engaging surface and said second glazed structure engaging surface.

16. The window assembly according to claim 11 wherein said spacer is coilable.

* * * * *

UNITED STATES PATENT AND TRADEMARK OFFICE

CERTIFICATE OF CORRECTION

PATENT NO. : 7,107,729 B2
APPLICATION NO. : 10/004365
DATED : September 19, 2006
INVENTOR(S) : James Lynn Baratuci et al.

It is certified that error appears in the above-identified patent and that said Letters Patent is hereby corrected as shown below:

Col. 1, line 50, “units” should read --unit--.

Col. 3, line 38, “illustrates” should read -- illustrate --.

Col. 3, line 41, “FIGS.” should read -- FIG.--.

Col. 4, line 22, insert -- invention -- between “present” and “having”.

Signed and Sealed this

Twenty-second Day of May, 2007

JON W. DUDAS
*Director of the United States Patent and Trademark Office*